US005402932A

United States Patent [19]

Fadaie

[11] Patent Number: 5,402,932

[45] Date of Patent: Apr. 4, 1995

[54] RECEPTACLE WITH CORNER LOCK

[75] Inventor: Saadat Fadaie, Antioch, Calif.

[73] Assignee: James River Paper Company, Inc., Richmond, Va.

[21] Appl. No.: 246,262

[22] Filed: May 19, 1994

[51] Int. Cl.[6] ..... B65D 5/30

[52] U.S. Cl. ..... 229/195; 229/197

[58] Field of Search ..... 229/195, 196, 197

[56] References Cited

U.S. PATENT DOCUMENTS

| | | | |
|---|---|---|---|
| 1,481,973 | 1/1924 | Bachmann | 229/195 |
| 2,488,704 | 11/1949 | Buttery | 229/195 |
| 2,712,409 | 7/1955 | Buttery | 229/195 |
| 3,086,691 | 4/1963 | Fobiano | 229/195 |
| 3,211,358 | 10/1965 | Pierce, Jr. | 229/195 |
| 3,226,006 | 12/1965 | Dunn | 229/195 |
| 3,368,734 | 2/1968 | Wainberg | 229/195 |
| 3,400,877 | 9/1968 | Pierce, Jr. | 229/195 |
| 3,556,384 | 1/1971 | Pierce, Jr. . | |
| 3,608,811 | 9/1971 | Frick . | |
| 3,908,889 | 9/1975 | Vjecsner . | |
| 3,918,630 | 11/1975 | Meyers . | |
| 3,991,932 | 11/1976 | Curren et al. . | |
| 4,091,985 | 5/1978 | Holzinger . | |
| 4,216,897 | 8/1980 | Collura et al. . | |
| 4,313,555 | 2/1982 | Sieffert . | |
| 4,339,041 | 7/1982 | Roberts et al. . | |
| 5,121,878 | 6/1992 | Wallin . | |

FOREIGN PATENT DOCUMENTS

| | | | |
|---|---|---|---|
| 1277110 | 9/1968 | Germany | 229/195 |
| 3029961 | 6/1981 | Germany | 229/195 |
| 754916 | 8/1956 | United Kingdom | 229/195 |
| 1119688 | 7/1968 | United Kingdom | 229/195 |

*Primary Examiner*—Gary E. Elkins
*Attorney, Agent, or Firm*—Thomas R. Lampe

[57] ABSTRACT

A receptacle includes pairs of opposed side panels which are connected by connector flaps. The connector flaps have two relatively movable flap portions and the flap portions cooperate with tabs formed in the side panels to lock the receptacle into assembled condition and prevent up and down movement of the connector flaps relative to the rest of the receptacle structure.

8 Claims, 2 Drawing Sheets

RECEPTACLE WITH CORNER LOCK

TECHNICAL FIELD

This invention relates to a receptacle which can be utilized as a tray or cover for accommodating articles. More particularly, the receptacle is constructed of a unitary blank and is characterized by its relative simplicity, low expense and ease of assembly.

BACKGROUND ART

A search of the prior art located the following United States Patents which are believed to be representative of the present state of the prior art: U.S. Pat. No. 3,991,932, issued Nov. 16, 1976, U.S. Pat. No. 4,091,985, issued May 30, 1978, U.S. Pat. No. 4,313,555, issued Feb. 2, 1982, U.S. Pat. No. 5,121,878, issued Jun. 16, 1992, U.S. Pat. No. 4,339,041, issued Jul. 13, 1982, U.S. Pat. No. 4,216,897, issued Aug. 12, 1980, U.S. Pat. No. 3,608,811, issued Sep. 28, 1971, U.S. Pat. No. 3,556,384, issued Jan. 19, 1971, U.S. Pat. No. 3,908,889, issued Sep. 30, 1975, and U.S. Pat. No. 3,918,630, issued Nov. 11, 1975.

With reference to the above-identified prior art, it can be seen that it is well known to form trays, covers and the like from unitary blanks of paperboard material. The devices, after assembly, are often held together by corner lock arrangements of various types. Considerable manual or machine manipulation of the blank, in particular at the corners thereof, is often required to assemble the tray or the like. Also, some prior art constructions are characterized by a relatively unstable or unreliable corner construction which can result in failure of the assembled receptacle.

DISCLOSURE OF INVENTION

The present invention relates to a receptacle which is formed from a unitary blank of sheet material and is characterized by its relatively low cost, strength and reliability, as well as by its ease of assembly from a blank.

The receptacle of the present invention includes a substantially rectangular main panel. A pair of opposed side panels are affixed to the main panel along fold lines and extend outwardly therefrom.

A second pair of opposed side panels is affixed to the main panel along fold lines and extends outwardly therefrom, the side panels of the first and second pairs of side panels forming four corners and each of the side panels having panel ends located at two of the four corners.

A connector flap is attached to a panel end of a side panel at each of the four corners, the connector flap extending outside of, parallel to, and in engagement with an adjacent side panel forming a corner with the side panel to which the connector flap is attached.

The adjacent side panel has a slit formed therein defining a tab. The connector flap has a first flap portion and a second flap portion, the first and second flap portions separated by a line of cut and movable relative to each other.

The first flap portion is positioned in the slit behind the tab and has a bearing surface in engagement with the adjacent side panel to resist movement of the connector flap relative to the adjacent side panel.

Other features, advantages, and objects of the present invention will become apparent with reference to the following description and accompanying drawings.

BEST MODE FOR CARRYING OUT THE INVENTION

Figure 1:
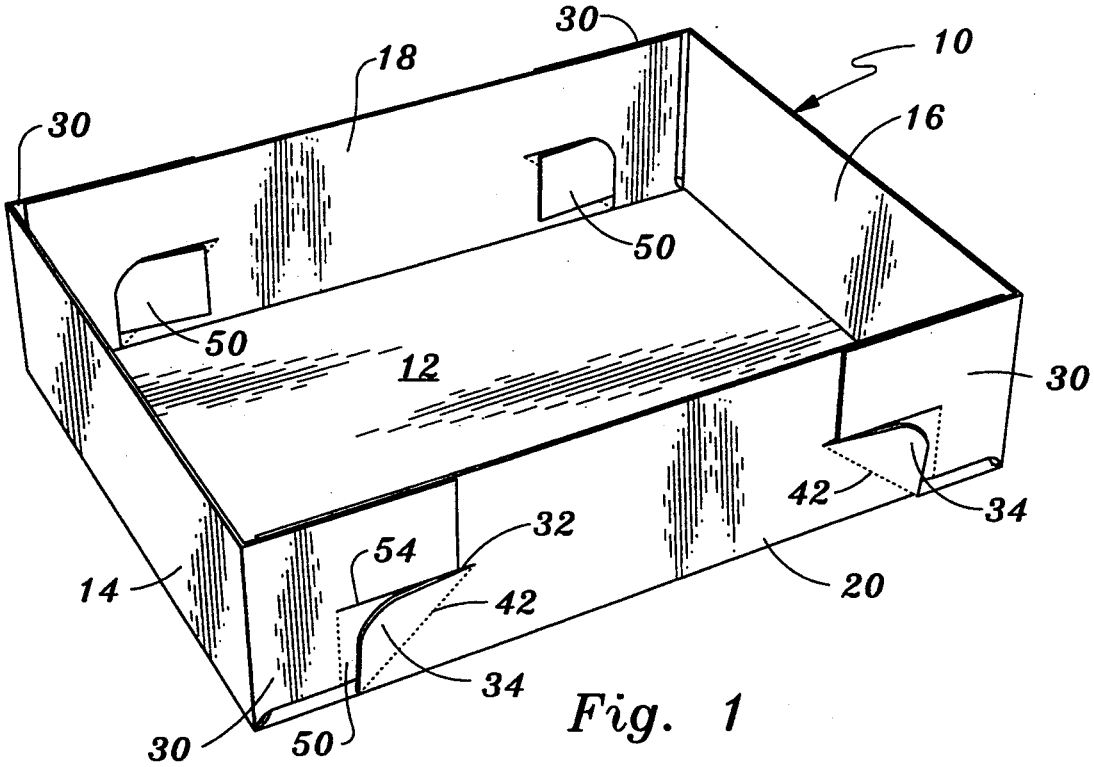
FIG. 1 is a perspective view of an assembled receptacle constructed in accordance with the teachings of the present invention.
Figure 2:
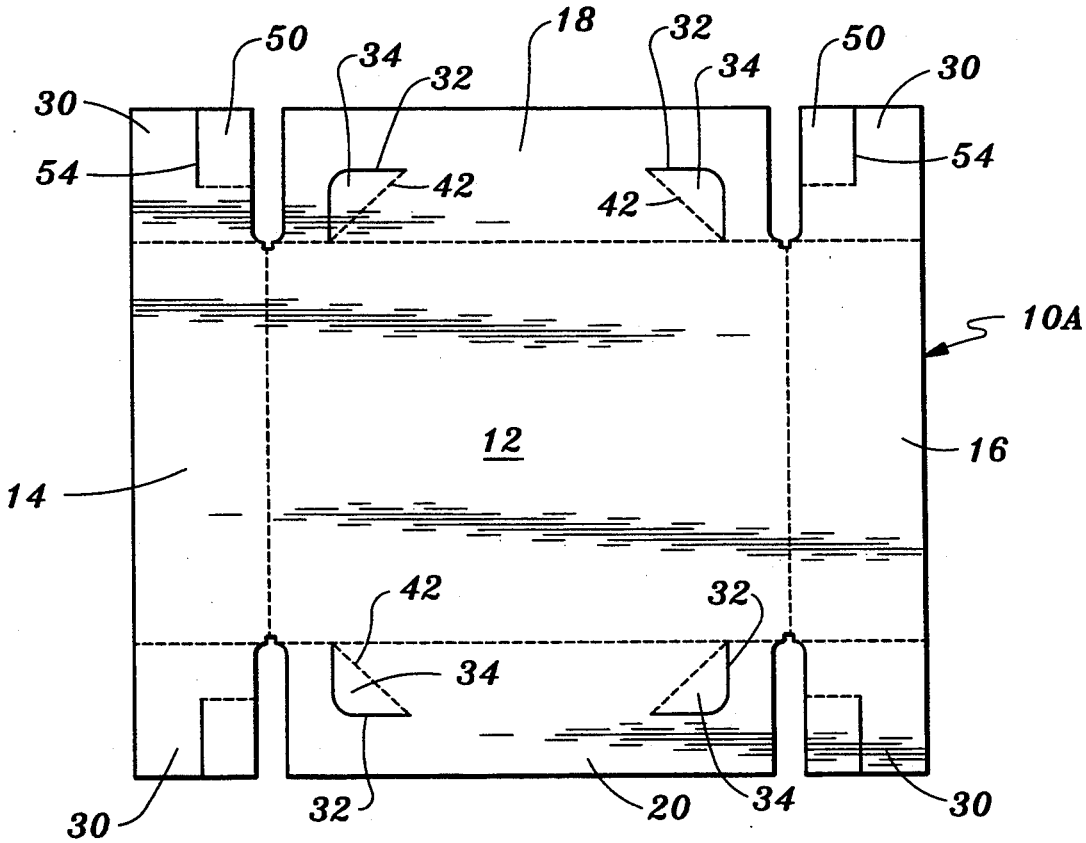
FIG. 2 is a plan view of a unitary paperboard blank utilized to construct the receptacle of FIG. 1.
Figure 3:
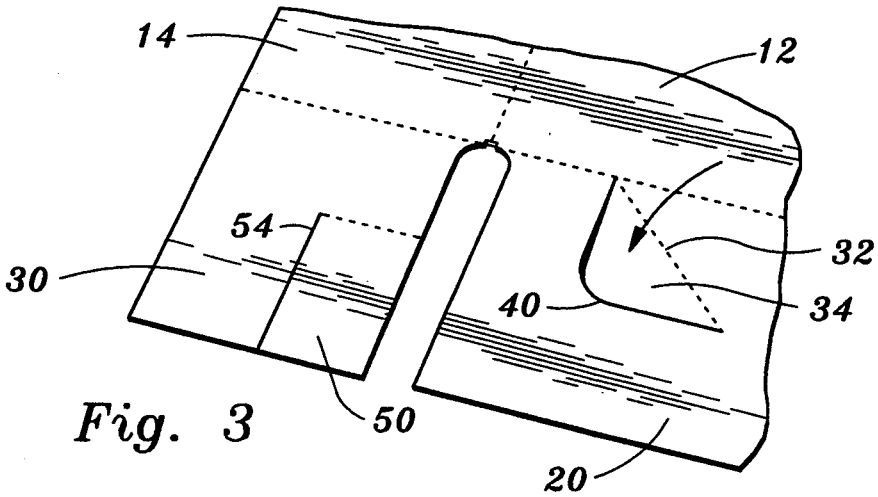
FIGS. 3–6 are enlarged, detail views of a corner segment of the blank and receptacle and illustrating the relative positions assumed by the structural components thereof during assembly of the receptacle from the blank.

Referring to the drawings, FIG. 1 illustrates a tray-like receptacle 10 constructed in accordance with the teachings of the present invention. Receptacle 10 is constructed from the blank shown in FIG. 2, the blank being identified by reference numeral 10A and comprising a die cut sheet of paperboard, preferably corrugated paperboard.

Receptacle 10 includes a rectangular-shaped main panel 12. Interconnected to the main panel along fold lines is a first pair of opposed side panels 14, 16. Likewise, a second pair or opposed side panels 18, 20 are connected to the main panel along fold lines at right angles to the fold lines associated with the first pair of opposed side panels. The side panels of the first and second pairs of side panels form four receptacle corners and each of the side panels has panel ends located at two of the four corners.

Side panels 14, 16 have connector flaps 30 connected to the panel ends thereof along fold lines in alignment with the fold lines disposed between side panels 18, 20 and the main panel 12. In the assembled receptacle, each connector flap 30 extends outside of, parallel to, and in engagement with an adjacent side panel forming a corner with the side panel to which the connector flap is attached. In FIG. 1, the connector flaps are outside of, parallel to and in engagement with side panels 18, 20.

Side panels 18, 20 each have two slits 32 formed therein defining tabs 34. Each slit 32 has a vertical slit segment 36 (FIG. 5) extending from the main panel 12, a horizontal slit segment 38 spaced a distance from and substantially parallel to the main panel, and a curved slit segment 40 interconnecting the vertical and horizontal slit segments.

Tabs 34 are hingedly connected to side panels 18, 20 along a straight hinge line 42 extending from and at an angle to the main panel. The hinge line 42 terminates at the spaced ends thereof at slit 32.

Each of the connector flaps 30 has a first flap portion 50 and a second flap portion 52. The first and second flap portions are separated by a straight line of cut 54 and are movable relative to each other.

FIGS. 3 through 6 illustrate one corner of the blank and receptacle and provide an illustration as to how the structural components thereof are assembled when forming the receptacle from the blank.

Figure 4:
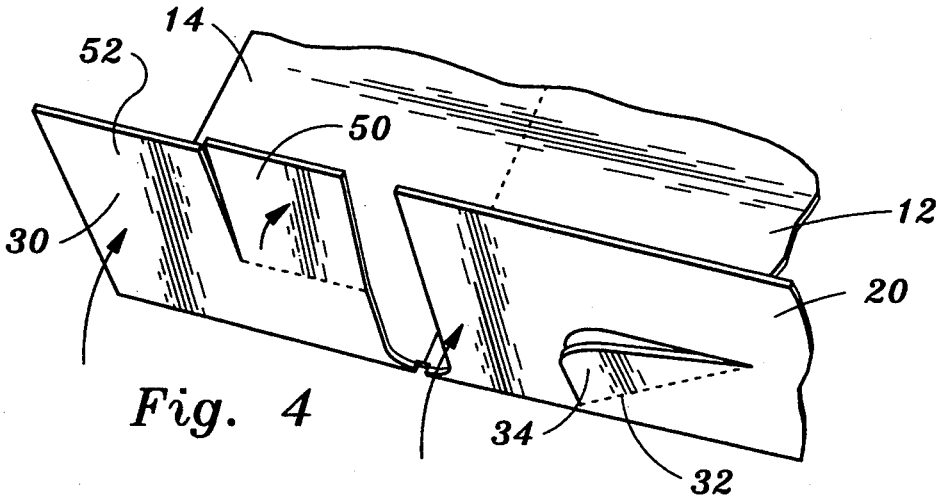

FIG. 4 shows the side panel 20 and connector flap 30 at the illustrated corner being bent upwardly so that they form a generally 90 degree angle with respect to the main panel and the side panel 14 which is co-planar with the main panel. Tab 34 is bent outwardly along its hinge line.

Figure 5:
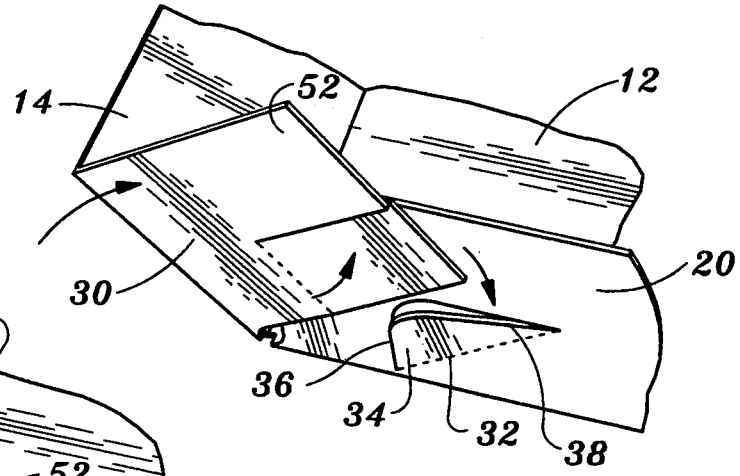

Now the blank is manipulated as shown in FIG. 5 to bend side panel 14 upwardly and bring the first flap portion 50 between the tab 34 and the side panel 20.

Figure 6:
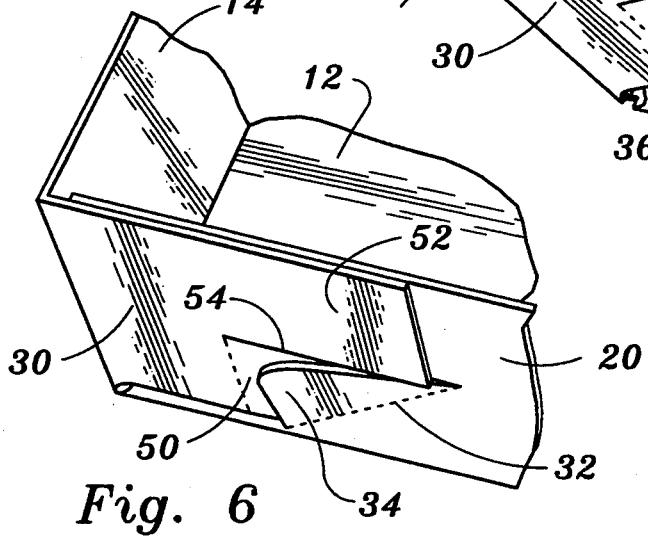

Bending movement continues until the structural components reach the condition illustrated in FIG. 6. In this configuration, side panel 14 forms a substantially 90 degree angle with main panel 12. First flap portion 50 is securely located behind tab 34, the tab serving to continuously bias the first flap portion inwardly in the direction of the receptacle interior.

In the configuration of FIG. 6, the illustrated corner is locked firmly and positively in place with the straight upper edges of the second flap portions and the side panels substantially in alignment. It will also be noted that line of cut 54 separating the first and second flap portions is located at the horizontal slit segment 38 of slit 32.

The bottom edge of second flap portion 52 bears against the top of tab 54 and the tab therefore cooperates with the second flap portion to keep it from being pushed or otherwise moved downwardly in the direction of the main panel 12. This maintains the connector flaps in alignment with their respective side panels to maintain a solid, stable construction and also present a pleasing appearance. The tab 34 cannot move back into alignment with its respective side wall because first flap portion 50 is interposed therebetween.

The distal end of the first flap portion 50 extends behind the tab and under the horizontal slit segment 38 partially defining the tab. Thus, the upper edge of the first flap portion comprises a bearing surface in engagement with a side panel to resist upward movement of the connector flap relative thereto. The lower edges of the first flap portions are disposed above the main body panel.

It can be seen from the above description that the connector flaps are not only locked into position relative to the side panels but also that the connector flaps are locked against both up and down movement.

I claim:

1. A receptacle formed from a unitary blank of sheet material, said receptacle having a receptacle interior and comprising:

a substantially rectangular main panel;

a first pair of opposed side panels affixed to said main panel along fold lines and extending outwardly therefrom;

a second pair of opposed side panels affixed to said main panel along fold lines and extending outwardly therefrom, said side panels of said first and second pairs of side panels forming four corners and each of said side panels having panel ends located at two of said four corners; and connector flaps attached to panel ends of side panels at said four corners, each connector flap extending outside of, parallel to, and in engagement with an adjacent side panel forming a corner with the side panel to which the connector flap is attached, each adjacent side panel having a slit formed therein defining a tab, and each connector flap having a first flap portion and a second flap portion, said first and second flap portions separated by a line of cut and movable relative to each other, each first flap portion being positioned in a slit behind a tab and having a bearing surface in engagement with an adjacent side panel to resist movement of the connector flap relative to the engaged adjacent side panel, each tab being hingedly connected to its respective adjacent side panel along a substantially straight hinge line extending from and at an angle to said main panel, and said substantially straight hinge lines terminating at spaced ends thereof at said slits.

2. The receptacle according to claim 1 wherein each said slit has a vertical slit segment extending from said main panel, a horizontal slit segment spaced a fixed distance from and substantially parallel to said main panel, and a curved slit segment interconnecting said vertical and horizontal slit segments.

3. The receptacle according to claim 2 wherein said line of cut separating said first and second flap portions is located at said horizontal slit segment.

4. The receptacle according to claim 3 wherein each tab cooperates with a first flap portion to continuously bias the first flap portion inwardly in the direction of said receptacle interior.

5. The receptacle according to claim 1 wherein said sheet material is die cut paperboard.

6. The receptacle according to claim 1 wherein said second flap portions and said side panels have straight upper edges substantially in alignment.

7. The receptacle according to claim 1 wherein said first flap portions have lower edges disposed above said main panel.

8. The receptacle according to claim 1 wherein said second flap portions have lower edges bearing against tabs to resist relative movement between said second flap portions and the tabs.

* * * * *